US011665466B2

(12) United States Patent
Kang et al.

(10) Patent No.: US 11,665,466 B2
(45) Date of Patent: May 30, 2023

(54) FABRIC SHEET-SHAPED OF AN AIR ABSORBENT FOR A SPEAKER-BOX SYSTEM USING POROUS CARBON FIBERS AND A SPEAKER-BOX SYSTEM INCLUDING THE SAME

(71) Applicant: NEXVEL CO., LTD, Yongin-si (KR)

(72) Inventors: Dae Lyun Kang, Suwon-si (KR); Seung Chan Lee, Gwangju-si (KR)

(73) Assignee: NEXVEL CO., LTD, Yongin-si (KR)

( * ) Notice: Subject to any disclaimer, the term of this patent is extended or adjusted under 35 U.S.C. 154(b) by 0 days.

(21) Appl. No.: 17/235,946

(22) Filed: Apr. 21, 2021

(65) Prior Publication Data

US 2021/0258682 A1 Aug. 19, 2021

Related U.S. Application Data

(63) Continuation of application No. PCT/KR2020/013747, filed on Oct. 8, 2020.

(30) Foreign Application Priority Data

Feb. 17, 2020 (KR) ..... 10-2020-0019128

(51) Int. Cl.
*H04R 1/28* (2006.01)
*H04R 1/02* (2006.01)

(52) U.S. Cl.
CPC ..... *H04R 1/2811* (2013.01); *H04R 1/02* (2013.01); *H04R 1/288* (2013.01); *H04R 1/2826* (2013.01); *H04R 2499/11* (2013.01)

(58) Field of Classification Search
CPC ..... H04R 1/02; H04R 1/2803; H04R 1/2811; H04R 1/2819; H04R 1/2826; H04R 1/2869; H04R 1/288; H04R 2499/11; H04R 2499/13
See application file for complete search history.

(56) References Cited

U.S. PATENT DOCUMENTS 4,657,108 A * 4/1987 Ward ..... H04R 1/2803 181/149
7,991,181 B2 * 8/2011 Saiki ..... H04R 1/2803 381/353
8,630,435 B2 * 1/2014 Mellow ..... H04R 1/225 381/345
8,767,998 B2 * 7/2014 Imamura ..... H04R 1/2803 381/349

(Continued)

FOREIGN PATENT DOCUMENTS

JP 4879971 B2 2/2012
JP 5873963 B2 3/2016

(Continued)

*Primary Examiner* — Huyen D Le
(74) *Attorney, Agent, or Firm* — Revolution IP, PLLC

(57) ABSTRACT

Disclosed is a sheet-shaped air absorbent for a speaker-box system using porous carbon fibers and a speaker-box system including the same, wherein an air absorbent for a speaker-box system includes at least one sheet member, and the sheet member was made by weaving fibers comprising a porous carbon-based substance or a sheet member with at least two layers, and the sheet member was made by weaving fibers comprising a porous carbon-based substance.

7 Claims, 10 Drawing Sheets

(56) References Cited

U.S. PATENT DOCUMENTS

| | | | | |
|---|---|---|---|---|
| 8,885,863 | B2 * | 11/2014 | Takashima | B82Y 40/00 181/149 |
| 8,942,402 | B2 * | 1/2015 | Yuasa | H04R 1/28 381/345 |
| 2009/0120715 | A1 * | 5/2009 | Saiki | H04R 1/2803 181/151 |
| 2010/0074463 | A1 * | 3/2010 | Fukunishi | H04R 1/2803 381/386 |
| 2012/0063627 | A1 * | 3/2012 | Takashima | B01D 53/28 381/346 |
| 2017/0195781 | A1 * | 7/2017 | Kang | B01J 20/28016 |

FOREIGN PATENT DOCUMENTS

| | | | |
|---|---|---|---|
| KR | 10-1709078 | B1 | 2/2017 |
| WO | 2006035564 | A1 | 4/2006 |

* cited by examiner

FABRIC SHEET-SHAPED OF AN AIR ABSORBENT FOR A SPEAKER-BOX SYSTEM USING POROUS CARBON FIBERS AND A SPEAKER-BOX SYSTEM INCLUDING THE SAME

CROSS REFERENCE TO PRIOR APPLICATIONS

This application is a Continuation Application of International application PCT/KR2020/013747 filed on Oct. 8, 2020, which claims priority to Korean application 10-2020-0019128 filed on Feb. 17, 2020, the entire contents of each of the above-identified applications are hereby incorporated by reference.

BACKGROUND

The present invention relates to a fabric sheet-shaped of an air absorbent for a speaker-box system using porous carbon fibers and a speaker-box system including the same.

Recently, a micro-speaker-box system used for a smartphone contains a sound resonance tube that acts as a sound resonance space in a certain part of a speaker-box module in which a core speaker is built-in in order to realize rich bass reproduction even in a compact and small size. In particular, in a micro speaker made in a small size, a sound resonance space plays an important role in acoustic characteristics of a low frequency region, and as a resonance space becomes larger, reproduction of a bass region becomes advantageous, and a reproduction bandwidth may be widened.

However, there are various restrictions such as a size and a shape in a designed structure of a smartphone, and a position of a discharge opening of speaker sounds, and etc., and thus, there is a limit that a volume of a sound resonance space that acts as a resonance space may not be increased. In order to improve this, it is possible to obtain an effect that a sound resonance space is expanded by a virtual back volume by filling various air absorbents in a volume of a given small sound resonance space and by using adsorption and desorption of air molecules according to sound propagation.

One of related existing technologies, a granular type of an air absorbent using zeolite has been disclosed in Republic of Korean Registered Patent No. 10-1709078. However, an existing zeolite air absorbent should be manufactured in a small size in order to have an effect of volume expansion, but when doing so, it is difficult to handle because it easily blows in the wind, and also filling fixed quantity into a sound resonance space is very difficult, and thus there is a disadvantage that it requires expensive precision filling equipment. In addition, a zeolite air absorbent has a problem of performance deterioration caused by being easily cracked or damaged on its surface by external forces since a zeolite air absorbent has weak mechanical strength, and a problem that acoustic characteristics are deteriorated because airflow is obstructed by fine fragments falling off a damaged air absorbent.

PRIOR ART LITERATURE

Patent Literature (Patent Document 1) Republic of Korean Registered Patent No. 10-1709078

SUMMARY

An objective of the present invention is to provide an air absorbent for a speaker-box that has an excellent reproduction of a low frequency band, and can expand range and to provide a speaker-box system including the same. In addition, this invention can prevent defective products from occurring and reduce costs during its manufacturing processes.

According to an embodiment of the present invention, an air absorbent for a speaker-box system contains at least one sheet member, and the sheet member is made by weaving fibers comprising a porous carbon-based substance.

Thickness of the sheet member may be 0.3 to 0.8 mm.

Horizontal and vertical lengths of the sheet member may be 3 mm to 8 mm, respectively.

According to another embodiment of the present invention, an air absorbent for a speaker-box system contains a sheet member having at least two layers, and the sheet member is made by weaving fibers comprising a porous carbon-based substance.

The sheet member may contain at least one folded area.

In addition, at least two sheet members may be disposed with it laminated.

According to another embodiment of the present invention, an air absorbent for a speaker-box system contains a pouch and at least one sheet member disposed in the pouch and the sheet member is made by weaving fibers comprising a porous carbon-based substance.

The pouch may contain a ventilating hole through which gas can move.

The pouch may be a shape of a mesh or a net.

The pouch may comprise one of a polymer substance, glass and a carbon-based substance. According to an embodiment of the present invention, a speaker-box system contains one of aforementioned air absorbents for a speaker-box system.

According to an embodiment of the present invention, an air absorbent for a speaker-box system and a speaker-box system including the same has an excellent reproduction of a low frequency band and can expand range.

In addition, this invention can prevent defective products from occurring and reduce costs during its manufacturing processes.

DESCRIPTION OF REFERENCE NUMERALS

Figure 1:
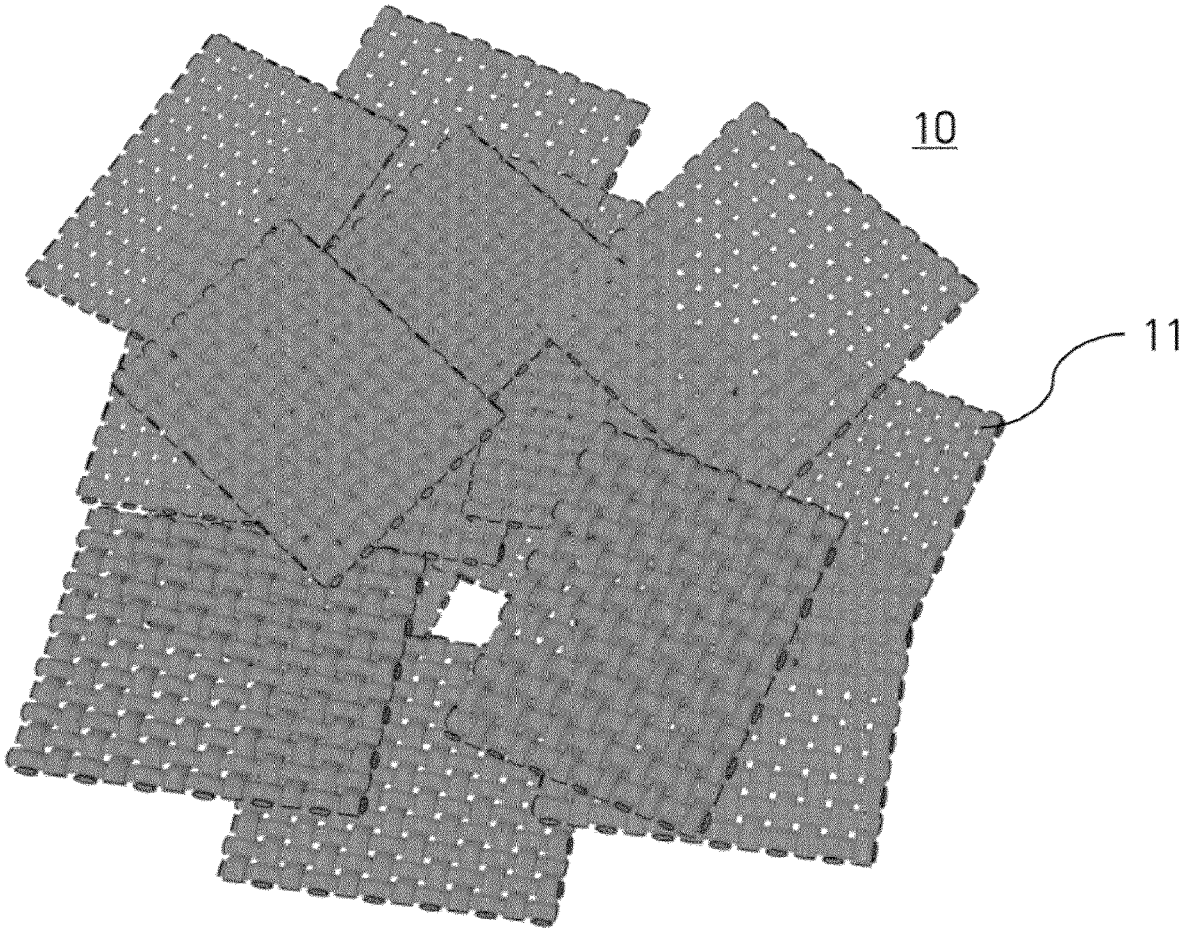
FIG. 1 is a schematic view showing an air absorbent for a speaker-box system according to an embodiment of the present invention.

10: Air absorbent for a speaker-box system
11: Sheet member
12: Fiber
13: Pouch
20: Speaker
30: Sound resonance space
40: Housing
60: Sound discharge opening
70: Voice coil connection FPCB
100: Speaker-box system

DETAILED DESCRIPTION

Hereinafter, with reference to the accompanying drawings, embodiments of the present invention will be described as follows. However, the embodiments of the present invention may be modified into various other forms, and the scope of the present invention is not limited to the embodiments described below. In addition, the embodiments of the present invention are provided in order to more completely explain the present invention to those having ordinary skill in the art. Therefore, shapes and sizes of elements in drawings may be exaggerated in order to explain more clearly, and elements indicated by the same reference numeral in drawings are the same elements. In addition, the same reference numerals are used for parts having similar functions and operations throughout the entire drawings. Additionally, throughout an entire specification, a phrase "contain/comprise a certain component" means, unless otherwise specified, not that other component is excluded, but that other components may be further contained/comprised.

Figure 2:
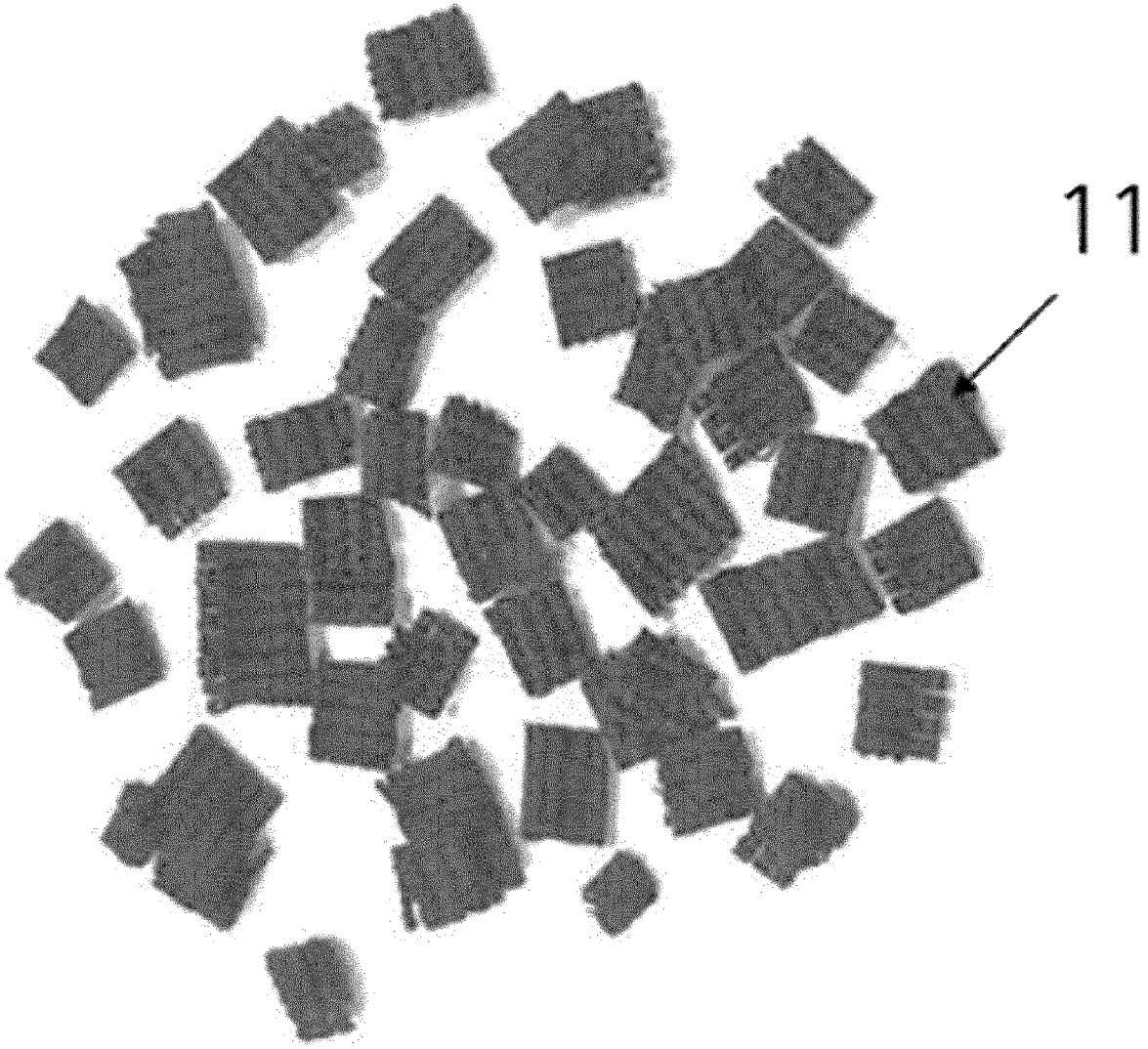
FIG. 2 is a photograph of an air absorbent for a speaker-box system according to an embodiment of the present invention.
Figure 3:
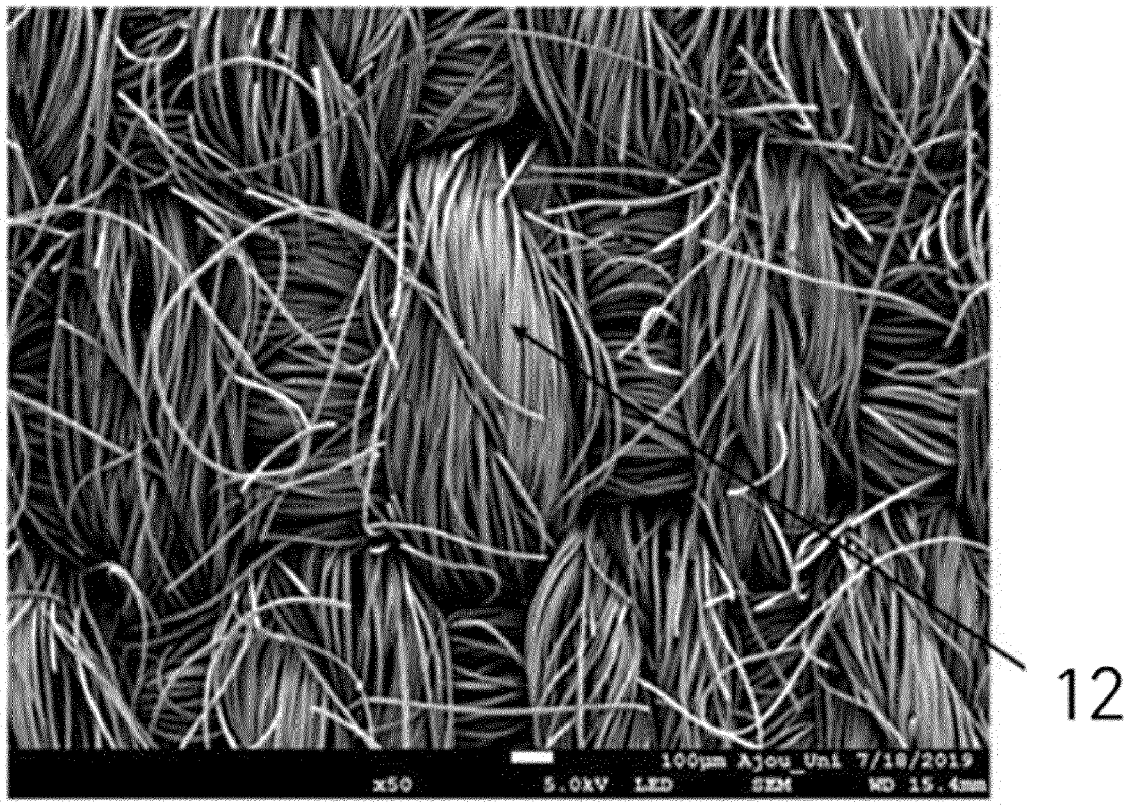
FIG. 3 is a photograph of a sheet member observed through a scanning electronic microscope (SEM).
Figure 4:
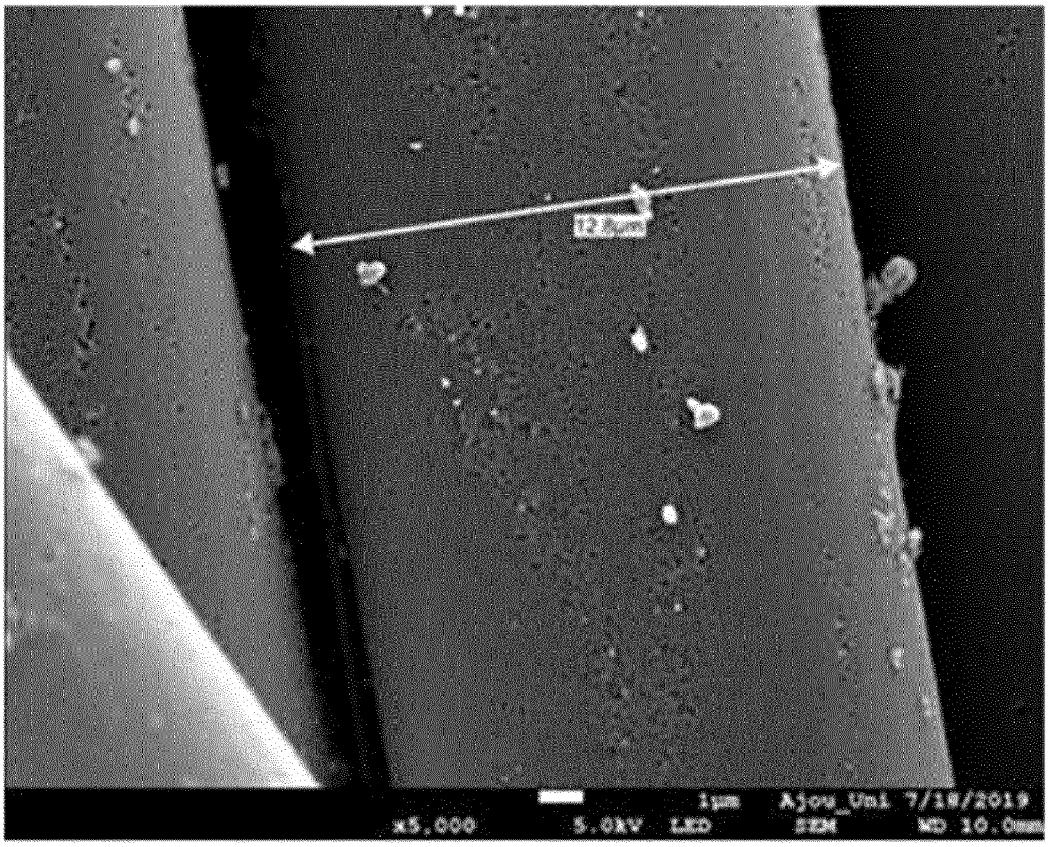
FIG. 4 is a photograph of fibers observed through a scanning electronic microscope (SEM).
Figure 5:
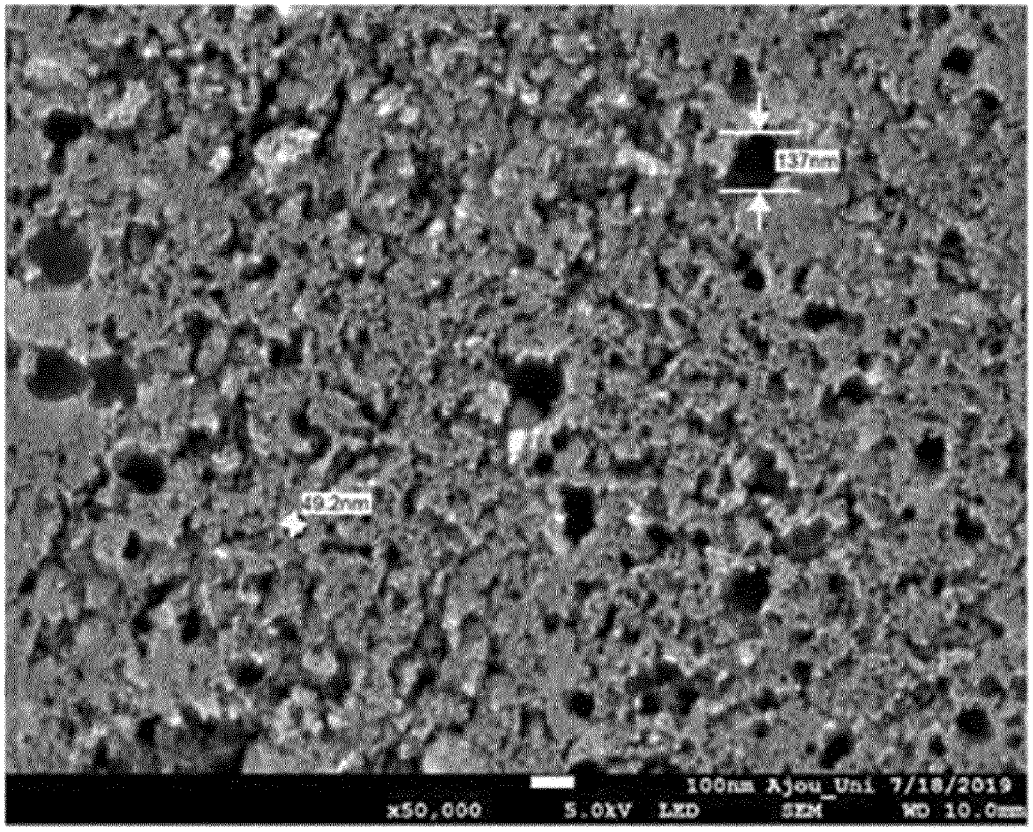
FIG. 5 is a photograph of a surface of a fiber observed through a scanning electronic microscope (SEM).

FIG. 1 and FIG. 2 is a schematic view showing an air absorbent for a speaker-box system according to an embodiment of the present invention. FIG. 3 is a photograph of a sheet member observed through a scanning electronic microscope (SEM), FIG. 4 is a photograph of fibers observed through a scanning electronic microscope (SEM), and FIG. 5 is a photograph of a surface of a fiber observed through a scanning electronic microscope (SEM).

With the reference to FIG. 1 and FIG. 2, according to an embodiment of the present invention, an air absorbent (10) for a speaker-box system contains at least one sheet member (11), and the sheet member (11) was made by weaving fibers (12) comprising a porous carbon-based substance.

Figure 8:
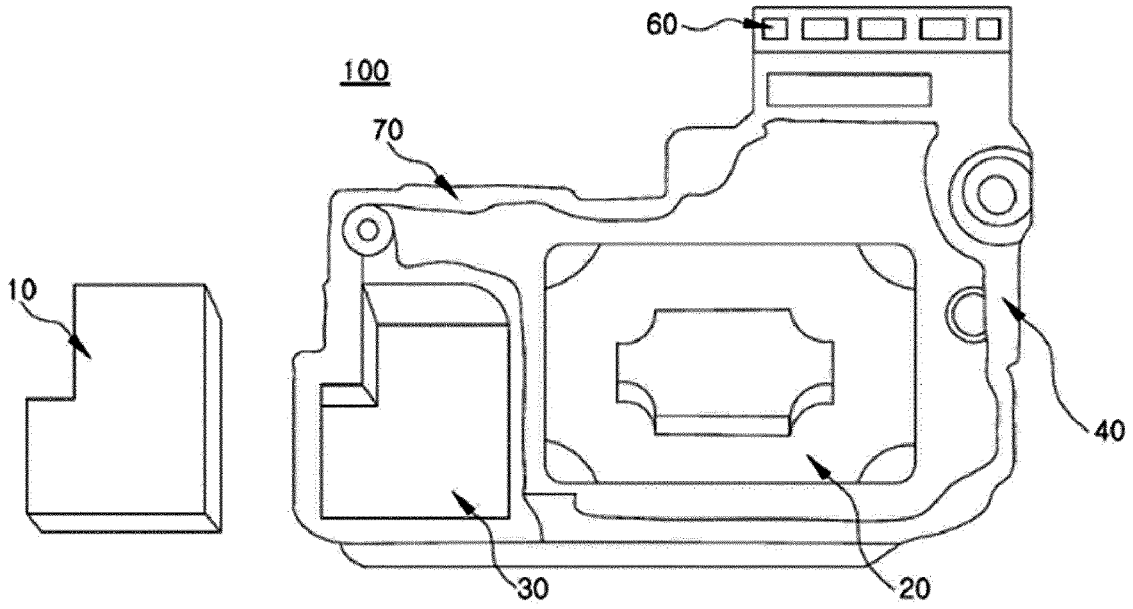
FIG. 8 is a schematic view showing a speaker-box system according to an embodiment of the present invention.
Figure 9:
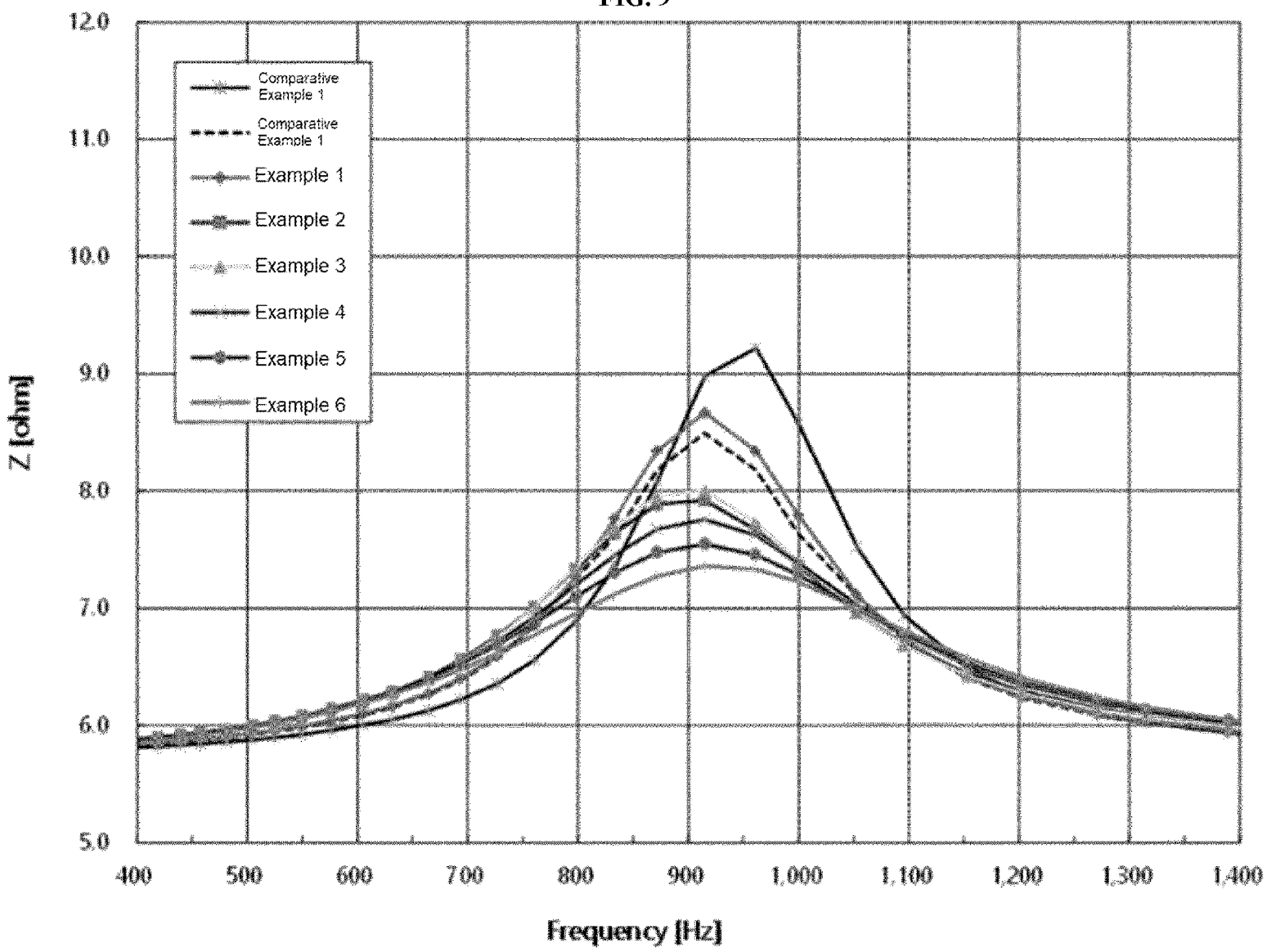
FIG. 9 is a graph of measurement of impedance values according to frequencies of a speaker-box system.

As shown in FIG. 8, a speaker-box system may be a box containing a sound resonance space or a system containing a speaker in a housing. ****The speaker-box system may make sounds that are generated from a speaker resonated and emitted from a sound resonance space in the box or the housing, and may improve sound quality and volume by reducing sound interference.

The sound resonance space is an important factor in characteristics of a bass region, and as the resonance space is larger, reproduction of a bass region becomes more advantageous, and a reproduction bandwidth can be widened.

An air absorbent for a speaker-box system, according to an embodiment of the present invention, may be disposed in a sound resonance space of the speaker-box system and may further improve acoustic characteristics of the bass region. The bass region may refer to a region of 1000 Hz or less, and, preferably, a frequency region of 100 to 700 Hz.

The air absorbent may produce an effect of expanding a physically limited sound resonance space as it may create a virtual back volume, that is, a virtual resonance space by adsorbing and desorbing air molecules. In addition, through this, it is possible to improve acoustic characteristics in the bass region or the low frequency region of a speaker-box system, and to widen a reproduction bandwidth.

A plurality of the sheet members is a sheet shape made by weaving fibers comprising a porous carbon-based substance. In an embodiment, a plurality of the sheet members may be disposed with them laminated. In addition, in another embodiment, they may be disposed to be bonded to each other. The bonding method may be implemented by heating and pressurizing a plurality of sheet members or by using an adhesive. In addition, the air absorbent for a speaker-box system may be integrated by seaming cutting edges of a plurality of the sheet members. The seaming may be a method of sewing cutting edges of a fabric in order to prevent a fabric formed by weaving from loosening, or may be a method of bonding. The seaming may be performed by hardening them after applying an adhesive to edge portions of the fabric.

The thickness of the sheet member may be 0.3 to 0.8 mm, preferably, 0.4 to 0.6 mm, most preferably, 0.55 mm. Through this, the widest BET-SSA specific surface area may be secured.

The sheet member may be a size that can be accommodated in a sound resonance space, that is, may be a smaller size than a size of the sound resonance space. More specifically, an area of a plane of the sheet members may be 0.7 to 1 time a size of bottom portion of a sound resonance space. Horizontal and vertical lengths of the sheet members may be 3 mm to 8 mm, respectively. Since diameter of a fiber is several mm or less, horizontal and vertical lengths of the sheet members may be 3 mm or more, preferably 5 mm or more respectively, in order to prevent a sheet made by weaving fibers from loosening and being disheveled. In case that horizontal and vertical lengths of the sheet members are less than 3 mm, a shape of sheet may not be maintained because woven fibers get loosened, an effect of volume expansion in a sound resonance space may decrease because BET-SSA specific surface area gets decreasing with respect to volume that fills in a sound resonance space, and handling it may be difficult because it blows easily in the wind due to its small size.

With the reference FIG. 3, a fiber (12) may be made by twisting micro-fibers. Diameter of the micro-fibers may be less than 0.03 mm, preferably 0.01 to 0.03 mm.

The fiber may comprise a carbon-based substance, and the carbon-based substance may be at least one of carbon black, activated carbon, expanded graphite, graphene, carbon nanotube, carbon fiber and graphite, preferably, may be phenol-based activated carbon. At this time, the activated carbon may be an activated carbon manufactured from at least one of wood, a coconut palm, coconut shell, and coal.

The air absorbent for a speaker-box system may comprise carbon, oxygen, and hydrogen, and may comprise 70% or more of the carbon with respect to a total weight.

With the reference to FIG. 4 and FIG. 5, the air absorbent for a speaker-box system may contain pores of 3 to 10 nm, preferably, 3 to 7 nm in diameter or a major axis length on its surface. The porous pores may be disposed on a surface and inside of fibers. In addition, they may be disposed on a surface and inside of micro-fibers which form the fibers. As a conventional spherical zeolite air absorbent has macro-pores of more than 15 nm in diameter or major axis length on its surface, and has micro-pores of less than 3 nm in diameter or major axis length inside, and macro-pores that allow air to flow in and out are formed on surface of the conventional spherical one, and thus, there's a limitation on improving acoustic characteristics by increasing volume of an air absorbent. That is, in the case of a spherical air absorbent, the macro-pores may act as a acoustic resistor by restraining air or sound flowing to reach micro-pores in an air absorbent. Therefore, as a volume ratio of the macro-pores becomes larger, an acoustic loss occur, and as an result, there may cause a problem of decreasing sound pressure of bass or a low frequency region.

Furthermore, in case that a spherical one may be formed with more than 0.5 mm in diameter, volume of macro-pores gets larger with respect to that of micro-pores, so an effect of volume expansion is significantly decreasing, and in a high frequency region of higher than 100 Hz to 200 Hz, depending on a surface area and a length, the macro-pores may block a passage of air or sound, and suppress air or sound from coming in through the micro-pores, and thus there cause a problem that an effect of volume expansion will not occur.

On the other hand, an air absorbent for a speaker-box system, according to an embodiment of the present invention, may contain pores of 3 to 10 mm in a major axis length on its surface thereof in 30 to 80 weight % with respect to the total weight, and through this, a specific surface area may be improved, and thus improvement of characteristics of a bass region may be increased.

In case of an air absorbent for a speaker-box system, according to an embodiment of the present invention, a value of BET-SSA (Brunauer-Emmett-Teller Specific Surface Area per unit weight), an indicator of an effect of volume expansion, may be more than 1500 m2/g, which is larger than a value of an conventional zeolite air absorbent (1000 m2/g), preferably 1500 to 2500 m2/g, and thus bass region may be expanded.

An air absorbent for a speaker-box system, according to an embodiment of the present invention, has low macro-pores and high micro-pores degree. Therefore, an air absorbent for a speaker-box system, according to an embodiment of the present invention, may lower values of an acoustic resistance generated while air move through macro-pores, and may suppress a sound pressure level generated by the acoustic resistance from being lowered.

In addition, an air absorbent for a speaker-box system, according to an embodiment of the present invention, may restrain a problem of abrasion or damages on surface by external power, and thus it is possible to reduce performance degradation due to damages. In addition, it may decrease a problem of decreasing acoustic characteristics by fragments generated while damaged.

Tensile strength of the air absorbent for a speaker-box system may be more than 200 N/mm2, preferably 300 to 400 N/mm2, so it may minimize generation of foreign substances due to friction between air absorbents even after dropping or impact.

In case that tensile strength of the air absorbent may be less than 200 N/mm2, there may occur problems that surface may be damaged by friction or impact between air absorbents, and fine fragments generated by the damage fill in lattice gaps of a ventilation net, and impede smooth flows of air or sound, and, because of this, there may occur a problem of deteriorating acoustic characteristics of a speaker.

Figure 6:
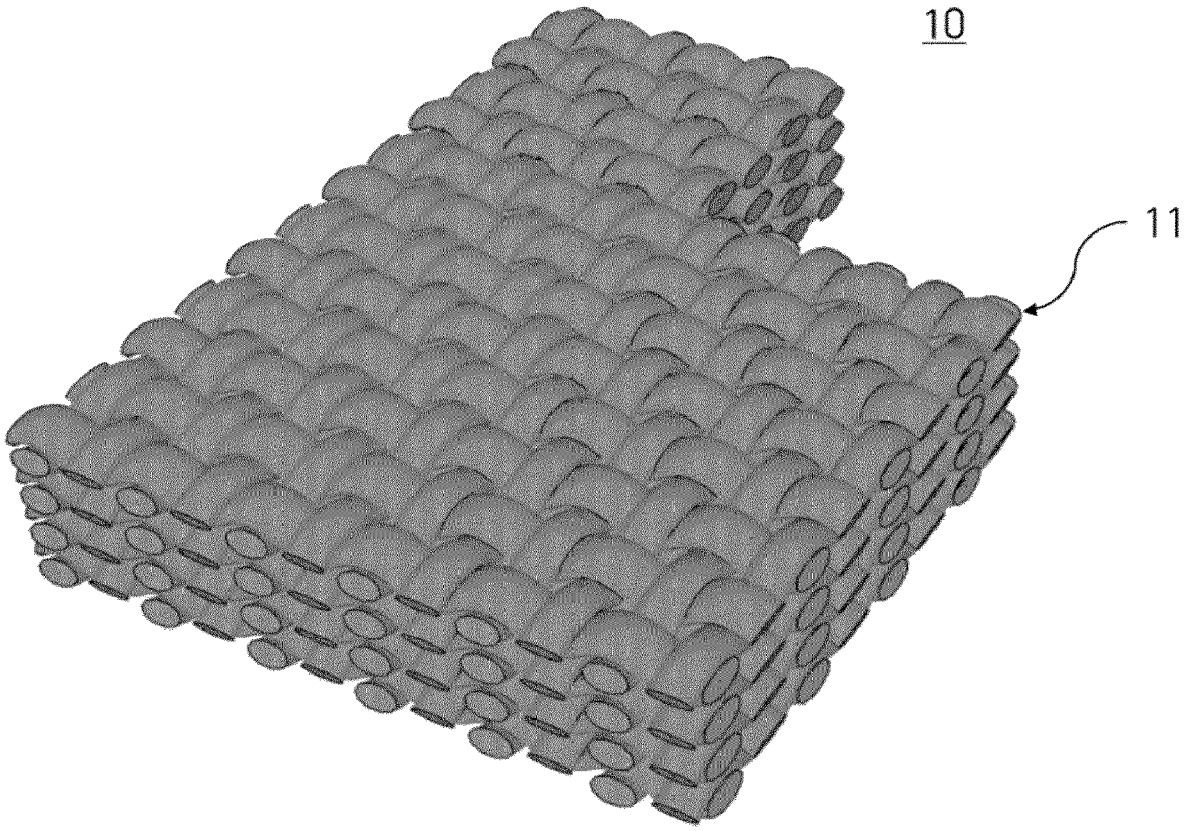
FIG. 6 is a schematic view showing an air absorbent for a speaker-box system according to another embodiment of the present invention.

FIG. 6 is a schematic view showing an air absorbent for a speaker-box system, according to another embodiment of the present invention. With the reference to FIG. 6, an air absorbent (10) for a speaker-box system, according to another embodiment of the present invention, contains a sheet member (11) having at least two layers and the sheet member (11) was made by weaving fibers comprising a porous carbon-based substance. The sheet member has been formed by weaving fibers comprising a porous carbon-based substance as has been previously explained.

What relates to the porous carbon-based substance, and the fibers may be the same as what has been previously explained.

The sheet member may contain at least one folded area. In this case, a lamination structure may be made by folding a sheet member at least once. Preferably, a sheet member may be folded twice to three times. In addition, more than two sheet members with at least once folded lamination structure may be laminated and disposed.

Or, at least two sheet members may be laminated and disposed. In this case, the sheet member may be a shape corresponding to a shape of a sound resonance space in a speaker-box system. Through this, not only an air absorbent for a speaker-box system can be easily disposed in the sound resonance space, but also an air absorbent occupying a sound resonance space can be manufactured with maintaining its volumetric ratio constant. Volume of the air absorbent for a speaker-box system may be more than 0.3 times a size of the sound resonance space.

The sheet member may be disposed with jointing each layer. The jointing methods may be implemented by pressurizing, heating a sheet member or using an adhesive. In addition, the air absorbent for a speaker-box system may be integrated by seaming cutting edges of the sheet members. The seaming may be a method of sewing cutting edges of the fabric in order to prevent a woven fabric from loosening, and may be a method of jointing. The seaming may be performed by applying an adhesive to the edge portion of the fabric and hardening it.

Thickness (tc) of the an air absorbent for a speaker-box system may be equal to or smaller than a depth (tb) of the sound resonance space. Thickness (tc) of a sheet member contained in the air absorbent for a speaker-box system may be 0.3 to 0.8 mm, preferably 0.4 to 0.6 mm, most preferably 0.55 mm. Through this, BET-SSA specific surface area, an indicator that shows an effect of volume expansion of an air absorbent, may become more than 1500 m2/g.

Figure 7:
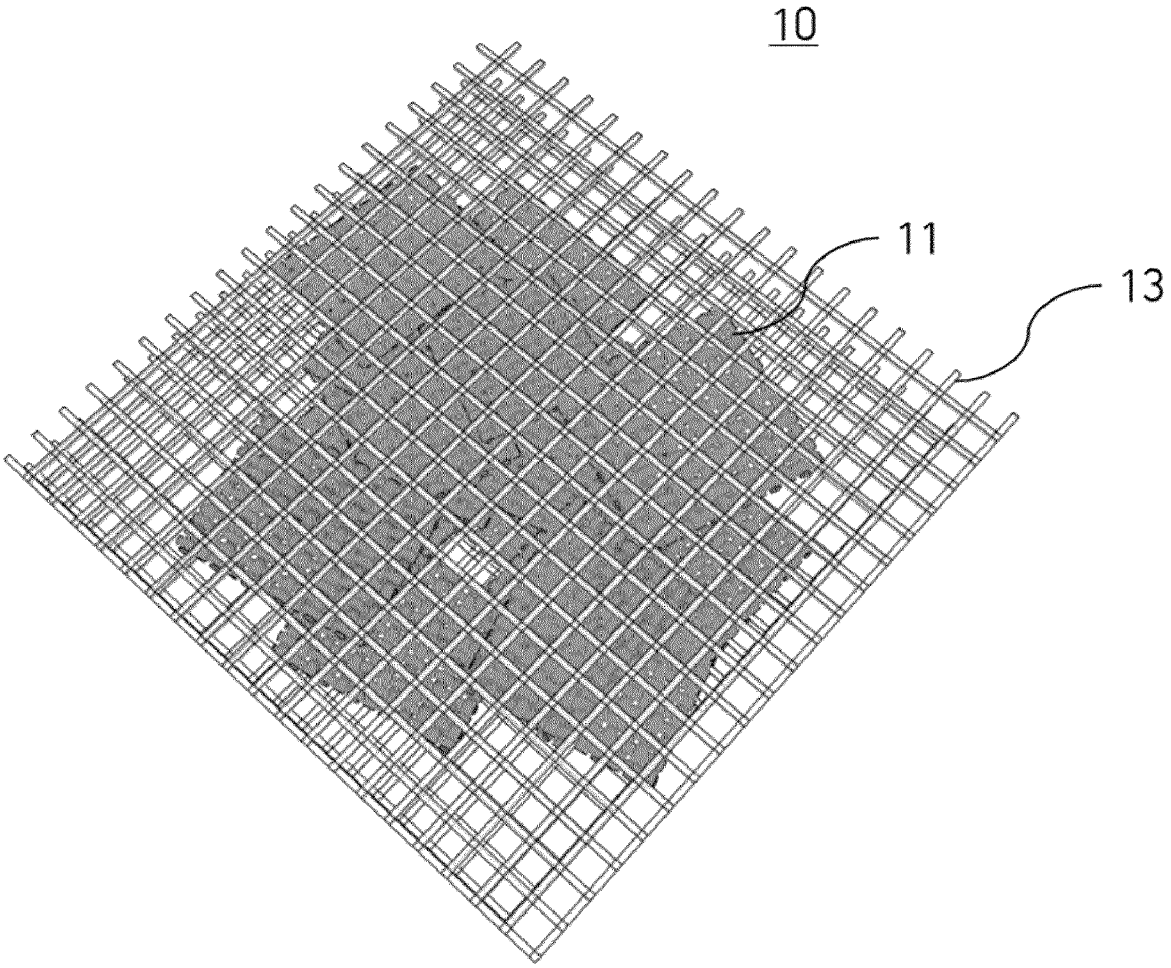
FIG. 7 is a schematic view showing an air absorbent for a speaker-box system according to another embodiment of the present invention.

FIG. 7 is a schematic view showing an air absorbent for a speaker-box system according to another embodiment of the present invention.

With reference to FIG. 7, an air absorbent (10) for a speaker-box system, according to another embodiment of the present invention, contains a pouch (13) and at least one sheet member (11) disposed in the pouch (13), and the sheet member (11) was made by weaving fibers comprising a porous carbon-based substance.

As providing an air absorbent in a pouch shape with at least one sheet member accommodated, during manufacturing process, can make an air absorbent disposed stably and easily in a sound resonance space, it can make manufacturing process simple, and reduce defective products and manufacturing costs.

In addition, as an air absorbent manufactured by certain criteria may be provided, it may keep a performance of a speaker-box system constant.

The sheet member, a fiber and a carbon-based substance may be the same as what has been previously explained.

The pouch may be a shape of a pocket or a net in which can accommodate at least one sheet member. In addition, the pouch may contain a ventilation hole through which gas can move. For this, the pouch may be a shape of a mesh or a net.

There is no limit on materials of the pouch, but they may be flexible in order to accommodate stably at least one sheet member. They may comprise one of a polymer substance glass and a carbon-based substance. In the case that the pouch comprises a carbon-based substance, it may implement a performance as an air absorbent together with a plurality of sheet members disposed in it. The pouch may have a shape corresponding to a shape of a sound resonance space. Through this, an air absorbent can be easily disposed in a sound resonance space.

FIG. 8 is a schematic view showing a speaker-box system according to an embodiment of the present invention.

A speaker-box system according to an embodiment of the present invention contains one of aforementioned air absorbents for a speaker-box system.

The speaker-box system may be applied to electronic devices such as smartphone, tablets and etc., and may contain a speaker, a sound resonance space, and an air absorbent for a speaker-box system disposed in the sound resonance space.

With the reference to FIG. 8, the speaker-box system (100) may contain a housing (40), a speaker (20), and a sound resonate space (30). The speaker (20) is accommodated in the housing (40), contains at least one of magnet, a voice coil, and a diaphragm, and may generate sounds converting an electronic energy into a mechanic energy. The sound resonate space (30) is accommodated in the housing (40), and contain an internal space that resonates sounds which are generated from a speaker.

The housing (40) may be equipped in electronic devices such as smartphone, and, in order to resonate sounds released from a speaker (20) that is disposed inside and to emit them from the housing, may contain a sound resonance space that resonates sounds, and a sound discharge opening (60) that is connected to the sound resonance space (30) spatially or acoustically.

The speaker (20) is not limited in size, but it may be a micro speaker with less than 20 mm of diameter or a major axis length, preferably less than 15 mm so that it may be built in compact electronic devices such as smartphone.

The speaker (20) may comprise a plurality of magnets, a voice coil, a voice coil connection FPCB (70), and a diaphragm. The voice coil may move with it disposed between the magnets. The voice coil connection FPCB (70) may be connected electrically to the voice coil. The diaphragm vibrates up or down according to an electrical signal by a mutual electromagnetic force generated between a magnetic circuit formed by the magnets and the voice coil when an electrical acoustic signal is applied from an external circuit via the voice coil connected FPCB.

At this time, sounds generated in response to vibrations of a diaphragm of the speaker (20) may be emitted outward through a sound discharge opening (60) that is connected spatially or acoustically in the housing (40).

The sound resonance space (30) may contain an internal space, and the internal space may be more than 0.2 cc in size. An air absorbent for a speaker-box system having same volume as a part or the whole volume of the internal space may be accommodated, and sounds may be resonated through the internal space and an air absorbent of a speaker-box system accommodated in the internal space. Through this, sound interference can be reduced, and thus, sound quality and volume can be improved.

In addition, a ventilation net is installed at one side of a sound resonance space of the speaker-box system, and this ventilation net is a sheet-shaped mesh net with holes or lattice gaps through which air or sounds flow, and it prevents the air absorbent (12) for a speaker-box system from being lost through holes or lattice gaps of a ventilation net.

An air absorbent for a speaker-box system according to an embodiment of the present invention may be accommodated in a sound resonance space that uses a ventilation net with holes or lattice gaps of less than 80 micro-meter, preferably 30 micro-meter in horizontal and vertical lengths.

Another embodiment of the present invention may be about audio equipment containing an aforementioned speaker-box system. The audio equipment may be one of a mobile phone, earphones, a bluetooth speaker, a wearable audio module and an audio module of devices for virtual reality, but there's no limit on them, and, preferably may be compact audio equipment accommodated in a portable electronic devices. Hereinafter, the present invention will be described in detail by Examples and Experimental Examples. However, the following Examples and Experimental Examples merely demonstrate the present invention, and the content of the present invention is not limited to the following Examples.

Manufacturing a Sheet Member

Step 1: A phenol-based activated carbon fiber having a diameter of about 0.013 mm was prepared.

Step 2: A sheet member was manufactured by forming the phenol-based activated carbon fiber in a fabric sheet shape with fabric weaving machine. Thickness of the sheet member, before pressurizing, was 0.55, 0.60, 0.65 mm.

Experiment Example 1: Experiment on BET-SSA Specific Surface Area According to Thickness of a Sheet Member Table 1 below is showing measurements of BET-SSA specific surface area according to thickness of sheet members that are manufactured before.

TABLE 1

| Thickness of sheet members [mm] | BET-SSA(Specific Surface Area per unit weight) specific surface area [m2/g] |
|---|---|
| 0.65 | >800 |
| 0.60 | >1,300 |
| 0.55 | >1,800 |

With the reference to the Table 1, BET-SSA specific surface area was the highest in case of a sheet member with 0.55 mm in thickness.

Manufacturing a Speaker-Box System

Example 1

A sheet member with 0.55 mm in thickness, which was manufactured before, was cut into a proper size using a cutting device, was folded into a lamination structure of two layers, and was disposed in a sound resonance space of a speaker-box system, and then, the sound resonance space was blocked with a ventilation net. The micro speaker-box system was a micro speaker, measuring 10 mm in horizontal length by 16 mm in vertical length, by 4 m in thickness, of which nominal impedance is 5.8 ohm, and it was made using a sound resonance space of about 0.3 CC.

Example 2

The sheet member with 0.55 mm in thickness, which was manufactured before, was cut using a cutting device so as to have about 90% volume of cross sectional area (horizontal and vertical lengths) of a sound resonance space of a speaker-box system. Two sheet members which had been cut this way were laminated and disposed in a sound resonance space, and the sound resonance space was blocked with a ventilation net. The same micro speaker-box system as Example 1 was used.

Example 3

Except that three sheet members, after being cut, were laminated and disposed in a sound resonance space, a speaker-box system was manufactured in the same way as in Example 2.

Example 4

Except that four sheet members, after being cut, were laminated and disposed in a sound resonance space, a speaker-box system was manufactured in the same way as in Example 2.

Example 5

Except that five sheet members, after being cut, were laminated and disposed in a sound resonance space, a speaker-box system was manufactured in the same way as in Example 2.

Example 6

Except that six sheet members, after being cut, were laminated and disposed in a sound resonance space, a speaker-box system was manufactured in the same way as in Example 2.

Comparative Example 1

Except that, with putting nothing in, a sound resonance space was blocked with a ventilation net, a speaker-box system was manufactured in the same way as in Example 2.

Comparative Example 2

Except that a conventional spherical zeolite air absorbent with 0.4 mm in diameter was filled into a sound resonance space so as to occupy more than 90% volume of a sound resonance space, a speaker-box system was manufactured in the same way as in Example 2.

Experiment Example 2: Measuring Impedance According to Frequencies from a Speaker-Box System This experiment was conducted in order to confirm improvement of bass characteristics according to a volume expansion effect of an air absorbent for a speaker-box system according to an embodiment of the present invention. The impedance values according to frequencies for speaker-box systems of Example 1 to Example 6, Comparative Example 1, and Comparative Example 2 were measured by using a impedance meter and the results were shown in the Table 9, and resonance points of a speaker-box system and peak impedance values at resonance points were posted in Table 2 as follows.

TABLE 2

| Classification | F0[Hz] Resonant Frequency | Zpeak [ohm] Peak Impedance | An Air Absorbent Volume Ratio with respect to A Sound Resonance Space Volume |
|---|---|---|---|
| Comparative Example 1 | 961.5 | 9.221 | 0% |
| Comparative Example 2 | 914.6 | 8.499 | 90% |
| Example 1 | 915.6 | 8.650 | 16.5% |
| Example 2 | 913.6 | 7.920 | 33% |
| Example 3 | 912.5 | 7.810 | 49.5% |
| Example 4 | 911.4 | 7.750 | 66% |
| Example 5 | 910.3 | 7.550 | 82.5% |
| Example 6 | 910.1 | 7.360 | 100% |

With the reference Table 2, in Comparative Example 1, a resonant frequency is 961.5 Hz and a peak impedance is 9.221 ohm, and in Comparative Example 2, a resonant frequency is 914.6 Hz and a peak impedance is 8.499 ohm.

As it went from Example 1 to Example 6, a resonant frequency moved to a low frequency band. In Example 2, a resonant frequency moved closer to a low frequency than in Comparative Example 2. In the Example 2, a resonant frequency moved about 47.9 Hz to a low frequency band as compared with Comparative Example 1, and moved about 1 Hz to a low frequency band as compared with Comparative Example 2.

This shows that if a volume ratio of an air absorbent for a volume of a sound resonance space is adjusted to be more than 33%, an improvement of bass characteristics can be economically realized as the same as or more than in Comparative Example 2 in which a conventional spherical zeolite air absorbent was tested.

Experiment Example 3: Measuring SPLs According to Frequencies for a Speaker-Box System This experiment was conducted in order to confirm improvement of bass characteristics according to a volume expansion effect of an air absorbent for a speaker-box system according to an embodiment of the present invention. Values of sound pressures (SPL) according to frequencies for a speaker-box system of Example 1 to Example 6, Comparative Example 1, and Comparative Example 2 were measured by using a sound meter and were shown in the FIG. 10.

Figure 10:
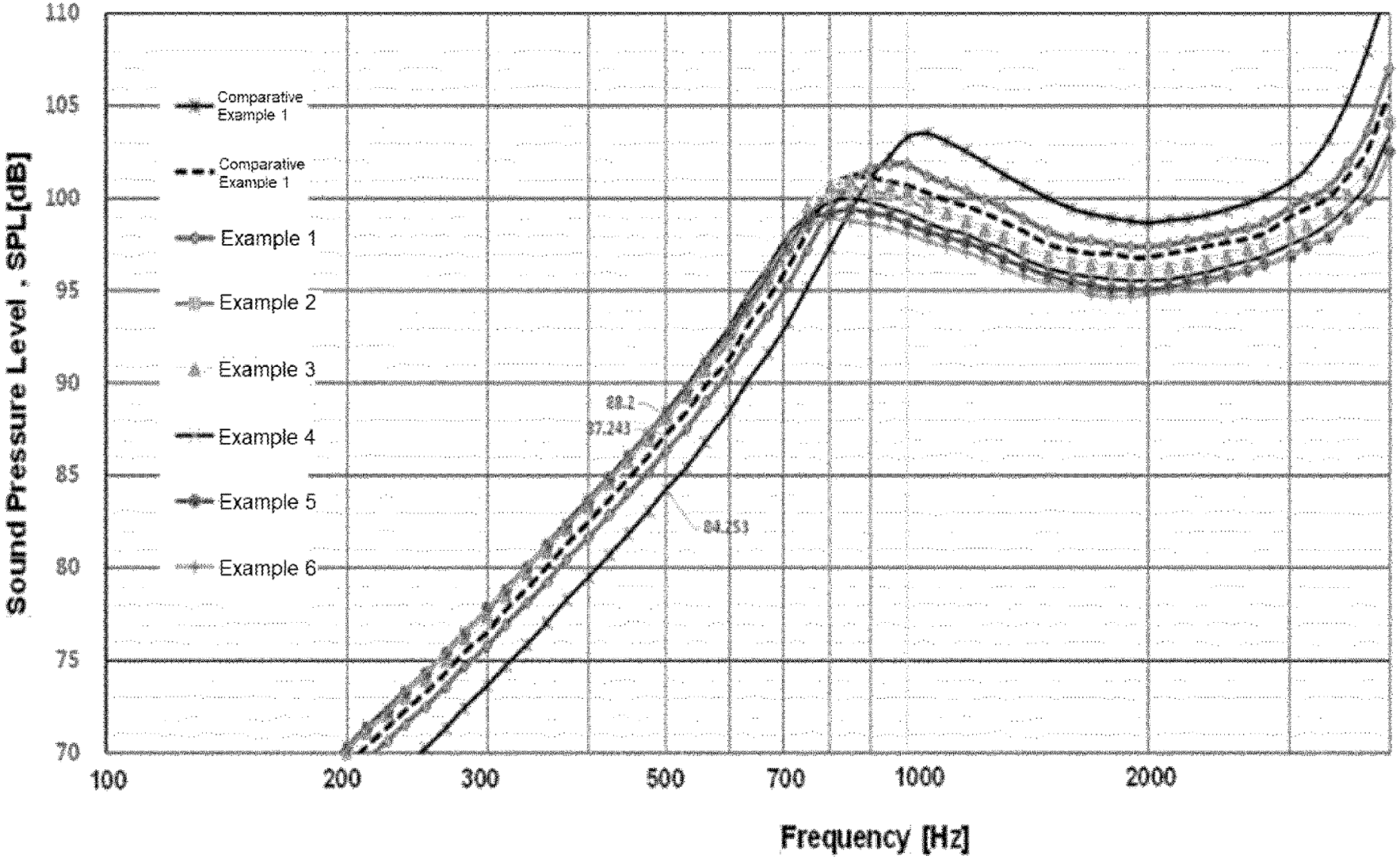
FIG. 10 is a graph of measurement of sound pressure levels according to frequencies of a speaker-box system.

With the reference to FIG. 10, it can be seen that in Example 2 to Example 6, sound pressure (SPL) was improved about 4.0 dB in a frequency region in a bass region of 200 to 700 Hz as compared with Comparative Example 1, and was additionally improved about 2.0 dB as compared with Comparative 2.

The scope of the present invention is not limited to the embodiments described and accompanying drawings, but is limited to the accompanying claim range. Therefore, within technical ideas of this invention stated in the claim range, the embodiments of the present invention may be replaced, transformed, and modified into various other forms by the person with ordinary skill in the art to which the inventions pertain and also this is within range of this invention.

What is claimed is:

1. An air absorbent for a speaker-box system which comprises a plurality of sheet members, and each sheet member made by weaving fibers comprising a porous carbon-based substance, wherein each of the plurality of the sheet members has a seamed edge which is disposed in the speaker-box system, wherein each of the weaved fibers is made of a phenol-based activated carbon and has a diameter of 0.013 mm so that a tensile strength of the air absorbent is 300 to 400 $N/mm^2$, wherein a thickness of each sheet member having weaved fibers is 0.55 to 0.60 mm, wherein a Brunauer-Emmett-Teller Specific Surface Area per unit weight (BET-SSA) of the air absorbent based on the thickness of each sheet member is 1500 to 2500 $m^2/g$.

2. The air absorbent for a speaker-box system of claim 1, wherein horizontal and vertical lengths of each sheet member are 3 mm to 8 mm, respectively.

3. A speaker-box system which comprises an air absorbent for a speaker-box system of claim 1.

4. An air absorbent for a speaker-box system, comprising:

a plurality of sheet members on which at least two layers of sheet members are disposed in a stacked form, each sheet member formed with weaved fibers, each fiber comprising a porous carbon-based substance, wherein a micro-pore size of the porous carbon-based substance is 3 to 7 nm in diameter, wherein each of the plurality of the sheet members has a seamed edge which is disposed in the speaker-box system, wherein each of the weaved fibers is made of a phenol-based activated carbon and has a diameter of 0.013 mm so that a tensile strength of the air absorbent is 300 to 400 $N/mm^2$, wherein a thickness of each sheet member having weaved fibers is 0.55 to 0.60 mm, wherein a Brunauer-Emmett-Teller Specific Surface Area per unit weight (BET-SSA) of the air absorbent based on the thickness of each sheet member is 1500 to 2500 $m^2/g$.

5. An air absorbent for a speaker-box system, comprising:

a pouch and at least one sheet member disposed in the pouch, the sheet member formed with weaved fibers, each fiber comprising a porous carbon-based substance, wherein a micro-pore size of the porous carbon-based substance is 3 to 7 nm in diameter, wherein each of the fibers is made of a phenol-based activated carbon and has a diameter of 0.013 mm, wherein a thickness of the sheet member formed with weaved fibers is 0.55 to 0.60 mm, wherein a Brunauer-Emmett-Teller Specific Surface Area per unit weight (BET-SSA) of the air absorbent based on the thickness of the sheet member is 1500 to 2500 $m^2/g$, wherein the pouch comprises a ventilation hole through which gas is able to pass.

6. The air absorbent for a speaker-box system of claim 5, wherein the pouch has a shape of a mesh or a net.

7. The air absorbent for a speaker-box system of claim 5, wherein the pouch comprises one of a polymer substance, glass and a carbon-based substance.

* * * * *